US009981720B2

(12) United States Patent
Van Vessem et al.

(10) Patent No.: US 9,981,720 B2
(45) Date of Patent: May 29, 2018

(54) DEVICE FOR AND METHOD OF TRANSFERRING PERSONNEL, EQUIPMENT AND/OR STRUCTURAL ELEMENTS FROM A SURFACE VESSEL TO AN OFFSHORE STRUCTURE

(71) Applicant: IHC Holland IE B.V., Sliedrecht (NL)

(72) Inventors: Henricus Gerardus Andreas Van Vessem, Vught (NL); Jurgen Arjan Zijlmans, Barendrecht (NL)

(73) Assignee: IHC HOLLAND IE B.V., Sliedrecht (NL)

( * ) Notice: Subject to any disclaimer, the term of this patent is extended or adjusted under 35 U.S.C. 154(b) by 0 days. days.

(21) Appl. No.: 14/439,510

(22) PCT Filed: Nov. 1, 2013

(86) PCT No.: PCT/NL2013/050783
§ 371 (c)(1),
(2) Date: Apr. 29, 2015

(87) PCT Pub. No.: WO2014/070015
PCT Pub. Date: May 8, 2014

(65) Prior Publication Data

US 2015/0284055 A1 Oct. 8, 2015

(30) Foreign Application Priority Data

Nov. 1, 2012 (NL) ..... 2009740

(51) Int. Cl.
*B63B 27/30* (2006.01)
*B63B 27/36* (2006.01)
(Continued)

(52) U.S. Cl.
CPC ..... *B63B 27/30* (2013.01); *B63B 21/00* (2013.01); *B63B 27/143* (2013.01); *B63B 27/16* (2013.01); *B63B 2021/001* (2013.01)

(58) Field of Classification Search
CPC ..... B63B 27/30; B63B 27/143; B63B 2017/0072; B63B 21/00; B63B 27/14;
(Continued)

(56) References Cited

U.S. PATENT DOCUMENTS 2,249,907 A * 7/1941 Perkowski ..... E02D 13/00 212/180
3,008,158 A * 11/1961 Stinson ..... B65G 67/00 114/230.13
(Continued)

FOREIGN PATENT DOCUMENTS

CA 2815052 A1 * 4/2012 ..... A01G 23/0955
CN 102015512 A 4/2011
(Continued)

OTHER PUBLICATIONS

International Search Report for corresponding foreign application PCT/NL2013/050783, filed Nov. 1, 2013.
(Continued)

*Primary Examiner* — Gregory W Adams
(74) *Attorney, Agent, or Firm* — Steven M. Koehler; Westman, Champlin & Koehler, P.A.

(57) ABSTRACT

The invention relates to a device for transferring personnel, equipment and/or structural elements from a surface vessel to an offshore structure, such as a wind turbine, or to another vessel comprising a foundation mounted or to be mounted on a surface vessel, an arm pivotally connected to the foundation and at least one gripper connected to the free end of the arm for coupling the arm to an offshore structure. A second arm is pivotally connected to the first arm.

20 Claims, 6 Drawing Sheets

(51) Int. Cl.
*B63B 21/00* (2006.01)
*B63B 27/14* (2006.01)
*B63B 27/16* (2006.01)

(58) Field of Classification Search
CPC ..... B63B 27/16; B63B 59/02; F05B 2240/95; F05B 2230/6102; E02B 3/26; F03D 1/001; F03D 1/003; F03D 1/005; Y02E 10/72
USPC ..... 114/230.14, 230.15, 230.17, 230.18, 114/230.19, 230.21, 258; 14/71.3, 71.5; 182/150, 2.1, 2.11, 63.1; 212/308; 414/10, 11, 138.2, 138.3, 139.5, 139.6, 414/139.7, 140.3, 140.4, 141.6, 142.6, 414/142.7, 23, 729, 736; 441/5; 52/123.1, 40; 901/1
See application file for complete search history.

(56) References Cited

U.S. PATENT DOCUMENTS 3,401,804 A * 9/1968 Link ..... B63B 23/04 212/250
3,426,719 A * 2/1969 Mizell ..... B63B 27/143 14/71.1
3,786,937 A * 1/1974 Faust ..... B66C 13/18 212/261
4,265,063 A * 5/1981 Muller ..... B66C 13/12 137/377
4,473,916 A * 10/1984 Connold ..... B63B 27/14 14/42
4,492,496 A * 1/1985 Arnold ..... B27C 5/08 405/250
4,605,132 A * 8/1986 van Seumeren ..... B63B 27/10 212/230
4,637,494 A * 1/1987 Iida ..... B62D 57/00 104/154
4,658,970 A * 4/1987 Oliphant ..... B66C 23/84 188/379
4,660,678 A * 4/1987 Krag ..... B62D 57/00 182/14
5,044,829 A * 9/1991 Hemminger ..... E01D 15/08 114/230.13
6,550,128 B1 * 4/2003 Lorenz ..... E21B 19/155 166/77.51
6,557,817 B2 * 5/2003 Waldschmitt ..... E04G 11/28 182/36
6,659,703 B1 * 12/2003 Kirkley ..... B63B 27/10 414/138.2
6,669,518 B2 * 12/2003 Kapsner ..... B66C 1/447 114/65 R
6,955,134 B2 * 10/2005 Prins ..... B63B 21/00 114/230.14
7,877,933 B2 * 2/2011 Watchorn ..... E02B 17/00 52/40
2010/0230370 A1 * 9/2010 Schneider ..... B63B 27/10 212/276
2011/0038691 A1 2/2011 Leske
2011/0119889 A1 * 5/2011 Numajiri ..... B63B 27/10 29/428

FOREIGN PATENT DOCUMENTS

DE 102009016082 10/2009
EP 1321671 A1 * 6/2003 ..... F03D 13/40
EP 1510496 A1 3/2005
EP 2487102 A1 8/2012
GB 2336828 11/1999
NL 8600973 11/1987
WO 9955579 A1 11/1999
WO 02/20343 3/2002
WO 2011154730 12/2011
WO 2012007002 1/2012
WO 2012021062 2/2012
WO 2012067519 5/2012
WO 2012069835 8/2012
WO 2012107459 8/2012

OTHER PUBLICATIONS

Notification of Transmittal of the International Preliminary Report on Patentability, for corresponding foreign application PCT/NL2013/050783, filed Nov. 1, 2013, dated Apr. 8, 2015.
Chinese Office Action for Chinese patent application No. 201380061465.1, dated Aug. 2, 2016.

* cited by examiner

DEVICE FOR AND METHOD OF TRANSFERRING PERSONNEL, EQUIPMENT AND/OR STRUCTURAL ELEMENTS FROM A SURFACE VESSEL TO AN OFFSHORE STRUCTURE

CROSS-REFERENCE TO RELATED APPLICATION

The present application is a national stage filing of International patent application Serial No. PCT/NL2013/050783, filed Nov. 1 2013, and published as WO 2014/070015 A1 in English.

BACKGROUND

The discussion below is merely provided for general background information and is not intended to be used as an aid in determining the scope of the claimed subject matter.

The invention relates to a device for transferring personnel, equipment and/or structural elements from a surface vessel to an offshore structure, in particular a fixed offshore structure, such as a wind turbine, or to another vessel, the device comprising a foundation mounted or to be mounted on a surface vessel, an arm, e.g. a telescopic boom, pivotally connected to the foundation, e.g. via at least one gimbal or pair of gimbals, and at least one gripper connected to the free end of the arm for coupling the arm to an offshore structure. The invention further relates to a method of transferring personnel, equipment and/or structural elements.

It is known to provide access to a platform of an offshore wind turbine by providing e.g. rubber buffers on the front of a vessel such that the buffers of the vessel push against landing tubes on each side of a ladder of the turbine support to create enough friction to prevent movement, such as roll, heave or yaw, of the vessel relative to the support in three planes. Personnel can then transfer across the gap between the front of the vessel and the access ladder, i.e. across the so-called splash zone.

As explained in WO 2012/107459, this arrangement suffers from the drawback that the frictional force between the vessel and the support is highly variable, and is dependent upon the difference between the thrust generated by the vessel and the wave action on the hull of the vessel, as well as any material such as slime and barnacles adhering to the landing tubes. The available friction can also be reduced as a result of roll of the boat, and it is necessary for personnel to step between the ladder and the vessel which is moving relative to the support of the wind turbine, making transfer hazardous, especially in rough seas.

One known attempt to overcome this problem consists of an access apparatus mounted to a vessel and having a platform for personnel which moves relative to the vessel to compensate for motion of the vessel relative to the turbine support, so that the platform is substantially stationary relative to the support of the wind turbine. However, this arrangement suffers from the drawback that the apparatus requires much power, is expensive to acquire and run, and requires a large vessel to accommodate it.

WO 2012/107459 relates to an access apparatus (numeral 2 in the Figures of WO 2012/107459) for enabling transfer of personnel between a seaborne vessel (6) and an offshore installation. The apparatus comprises a body (18) adapted to be mounted to a deck (4) of a seaborne vessel, clamping members (10) adapted to grip a buffer tube, mounted to a support of an offshore installation, therebetween, to limit vertical movement of the buffer tube relative to the clamping members, wherein the clamping members can pivot relative to the body about a respective single pivot axis extending in at least two mutually perpendicular directions.

WO 02/20343 relates to a vessel provided with a telescopingly extendable gang plank mounted thereon for movement about a vertical axis. A coupling device provided at the free end of the gang plank is adapted to enclose a vertically directed engagement rod on an offshore pole body and thus connect the ship to the pole body. With the ship manoeuvred in a certain position the gang plank may be either directed and extended towards the engagement rod or be manoeuvred while taking its extended position laterally into contact with the engagement rod and subsequently (partially) retracted again.

WO 2012/069835 relates to a lift (2) to enable access between a waterborne vessel (1) and a structure (30). In an embodiment shown in FIG. 3 of WO 2012/069835 "The access lift 2 further comprises a base 5 . . . which supports the lift shaft assembly 3 (and the platform 4). . . . damped roller assembly 10 further comprises a yoke beam 15, to which the rollers 11 are rotatable mounted. . . . The yoke beam 15 further supports an actuated arm 16 for each of rollers 12, . . . " The yoke beam (15) is also attached to the base (5), i.e., the arm (16) and the lift shaft assembly (3) are both attached to the base, not to each other.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background. An aspect of the present invention to provide a transferring device, in particular one which allows relatively straightforward coupling of the arm to an offshore structure and/or relatively safe or comfortable transfer of personnel and/or equipment.

To this end, the device includes a second arm that is pivotally connected to the (first) arm.

In an embodiment, a support for personnel, e.g. a so-called basket, and/or a second gripper for structural elements, e.g. building components of an offshore structure under construction, is connected to the second arm at or near its free end.

In another embodiment, the second arm is pivotally connected at or near the free end of the first arm or movable along the first arm, e.g. from a position at or near the foundation to a position at or near the free end of the first arm.

With the present invention, the first arm can be coupled to the offshore structure at a first location, e.g. a lower location facilitating the coupling of the first grippers to the structure, and, by means of the second arm mounted on the first arm, personnel, equipment and/or structural elements can be transferred to a second location, e.g. a higher location such as a wind turbine transition piece platform.

In an embodiment, the first gripper, the second arm and, if present, the support and/or second gripper form a module, which module is detachable from the first arm, at least upon coupling the first gripper to an offshore structure.

In a more specific embodiment, the module comprises a power supply and/or a manually operable power generator, thus providing the module with a degree of autonomy and allowing the vessel to leave once it is detached from the module, and or a controller for operating the module when detached from the vessel.

In an embodiment, at least one of the pivotal connections, preferably both the connection between the first arm and the foundation and the connection between the second arm and the first arm, comprises at least two gimbals, i.e. are pivotable about at least two axes.

In another embodiment, at least one of the arms, preferably both the first arm and the second arm, is telescopic.

The invention also relates to a surface vessel comprising a device according to any one of the preceding claims for transferring personnel, equipment and/or structural elements from the vessel to an offshore structure.

The invention also relates to a method of transferring personnel, equipment and/or one or more structural elements from a surface vessel to an offshore structure, such as a wind turbine, or to another vessel comprising the steps of coupling a first arm, pivotally connected to the vessel, to an offshore structure, transferring personnel, equipment and/or one or more structural elements from the surface vessel to the offshore structure by means of a second arm that is pivotally connected to the first arm.

In an embodiment, the method comprises actively compensating for the motions of the vessel during the coupling of the arm to the offshore structure, preferably such that the free end of the (first) arm relates to the offshore structure.

To reduce power consumption, in an embodiment, compensation is switched to idle when the arm is coupled to the offshore structure. I.e., after coupling, the distal end of the arm (at the coupling) relates to the offshore structure and the proximal end of the arm (at the foundation) and the vessel move freely with respect to said structure.

In an embodiment, a support for personnel, e.g. a so-called basket, and/or a second gripper is connected to the second arm at or near its free end and the (pivotal) motion of the support and/or the second gripper is initially synchronized with the vessel. After personnel, equipment and/or structural elements have been loaded on or attached to the second arm, the pivotal motion of the support and/or the second gripper is synchronized with the offshore structure, e.g. when a downward movement of the vessel is detected and/or by moving the support and/or the second gripper upwards, away from the deck of the vessel.

In another embodiment, the offshore structure comprises a platform for personnel and equipment and personnel and/or equipment is moved, by means of the second arm, from the vessel to the platform.

In yet another embodiment, one or more structural elements are moved, by means of the second arm, from the vessel to the offshore structure. I.e., the device and method of the present invention are employed during the building of an offshore structure.

In a further embodiment, the first gripper, the second arm and, if present, the support and/or second gripper form a module and, upon coupling the first gripper to an offshore structure, the module is detached from the first arm and thus from the vessel.

Within the framework of the present invention, "near" the free end of the arm is defined as closer to the free or distal end than to the pivotal or proximal end of the arm. A gimbal is a pivoted support that allows the rotation of an object, e.g. a telescopic arm, about an axis. A set of e.g. two or three gimbals, one mounted on the other typically with orthogonal pivot axes, may be used to allow an object, e.g. a basket, mounted on the innermost gimbal to remain independent of the rotation of the vessel, e.g. to maintain the free end of an arm related to an offshore structure despite the motions of the vessel.

BRIEF DESCRIPTION OF THE DRAWINGS

Aspects of the invention will now be explained in more detail with reference to the drawings, which schematically show embodiments of the device and method.

DETAILED DESCRIPTION OF THE ILLUSTRATIVE EMBODIMENTS

Elements that are identical or performing substantially the same function are denoted by the same numeral.

Figure 1:
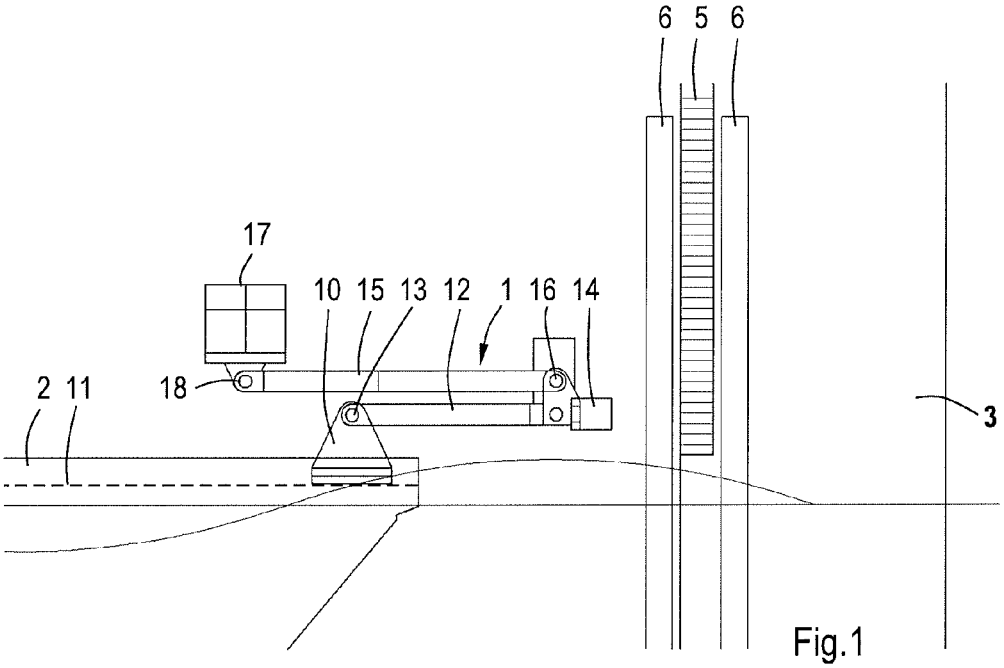
FIG. 1 is side view of a first example of a transferring device.

FIG. 1 shows a first embodiment of a device 1 for transferring personnel from a surface vessel 2 to an offshore structure. In this example the structure is a wind turbine 3 comprising a platform 4 (FIG. 2A), a ladder 5 providing access to the platform 4, and landing tubes 6 on either side of the ladder 5.

The device 1 comprises a foundation 10 mounted on the stern deck 11 of the vessel 2, a first telescopic arm 12 pivotally connected by a pair of gimbals 13 to the foundation 10 and a pair of grippers 14 connected to the free end of the first arm 12 for coupling the first arm 12 to an offshore structure, such as the wind turbine 3. A second telescopic arm 15 is pivotally connected to the first arm 12 by a pair of gimbals 16 located near the free end of the first arm 12. Further, a basket 17 for transferring personnel and small equipment is pivotally connected to the free end of the second arm 15 by means if one or two gimbals 18.

Figure 2A:
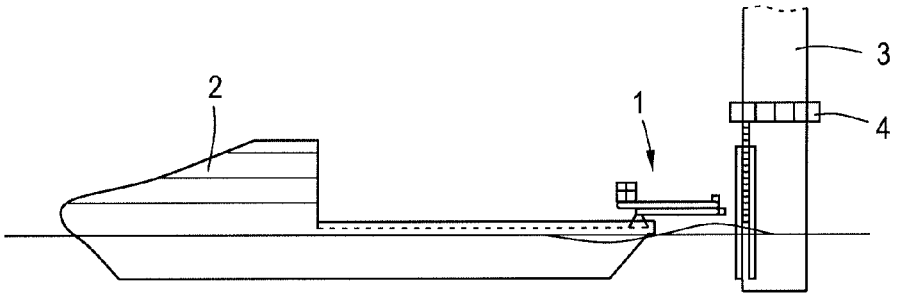
FIGS. 2A and 2B are side views of the coupling of the device in FIG. 1 to an offshore wind turbine.
Figure 2B:
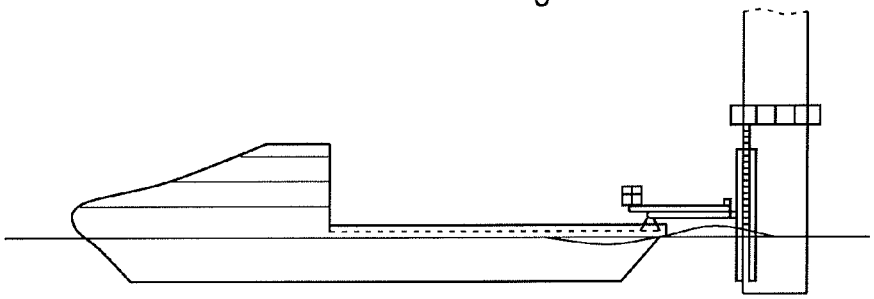

FIGS. 2A and 2B show how the vessel 1 maneuver its stern towards the wind turbine 3 and the first arm 12 is extended towards the landing tubes 6 of a wind turbine 3, while actively compensating for the motions of the vessel 2 such that the free end of the first arm 12 and the gripper 14 relate to the offshore structure. The first arm 12 is subsequently coupled to the landing tubes 6 by means of the grippers 14 (FIG. 2B) and, once a coupling has been established, motion compensation is switched to idle.

Figure 3A:
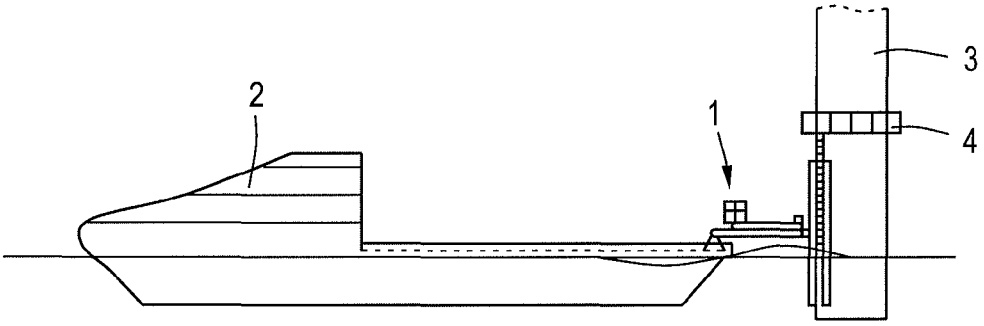
FIGS. 3A to 3C are side views of the transferring of personnel or equipment to the offshore wind turbine.
Figure 3B:
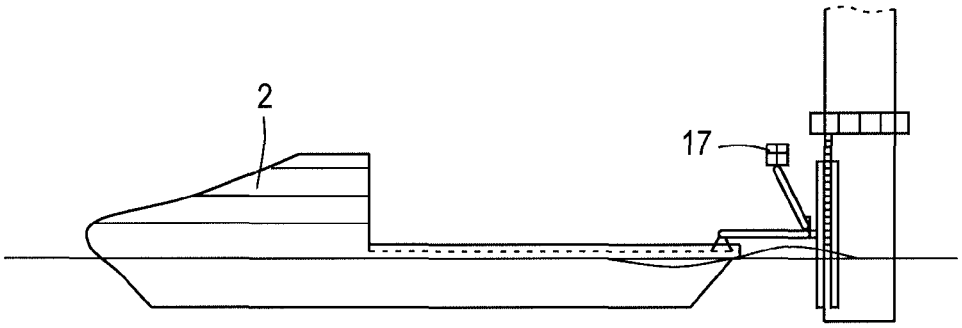
Figure 3C:
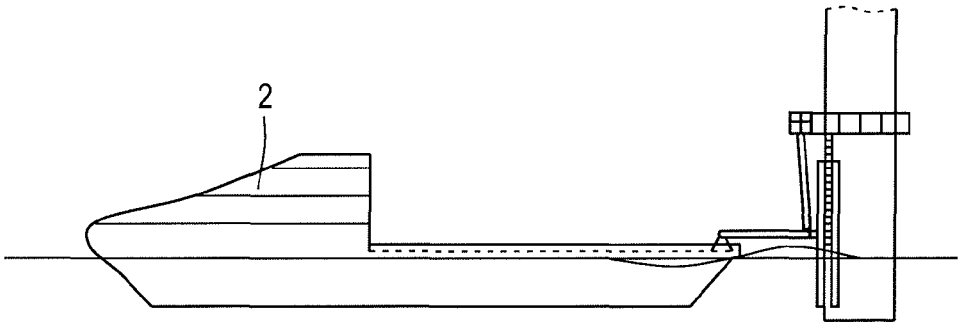

Subsequent events are shown in FIGS. 3A to 3C. Personnel embarks and/or small equipment is loaded on the basket 17 while the basket 17 rests e.g. on the foundation 10 or directly on the deck 11 (FIG. 3A), i.e. its motion is synchronized with the vessel 2. When complete, the motion of the basket 17 is synchronized with the offshore structure, e.g. by moving the basket 17 upwards, away from the deck 11 of the vessel 2 (FIG. 3B). The second arm 15 is extended and the basket 17 moved to the platform 4 on the wind turbine 3, enabling transfer to the platform 4 without employing the ladder 5 (FIG. 3C).

FIGS. 4A to 4D show the same procedure, albeit with a second example of the device and method. In this example, the gripper 14, the second arm 15, the basket 17, and a hydraulic power supply form a module 25, which module 25 is detachable from the first arm 12, at least upon coupling the first gripper 14 to an offshore structure 3. The module 25 can include a power supply and/or a manually operable power generator, thus providing the module with a degree of autonomy and allowing the vessel to leave once it is detached from the module, and or a controller for operating the module 25 when detached from the vessel 1. The module 25 further comprises a controller for operating the arm 15 and basket 17. The power supply, power generator and controller are collectively shown at 26, which is best seen in FIG. 4E.

Figure 4A:
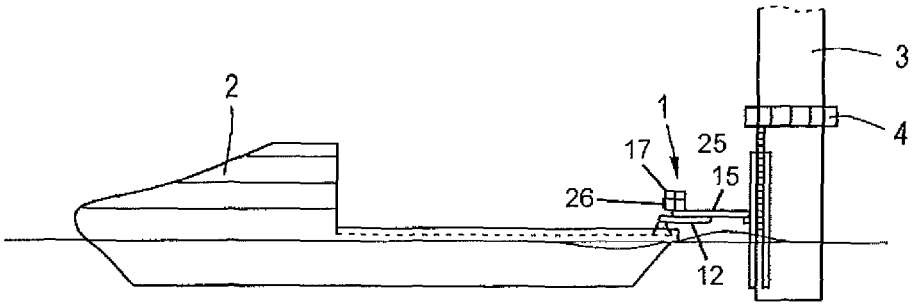
FIGS. 4A-4E are side views of the transferring of personnel or equipment similar to that shown in FIGS. 3A to 3C, after the vessel left.
Figure 4B:
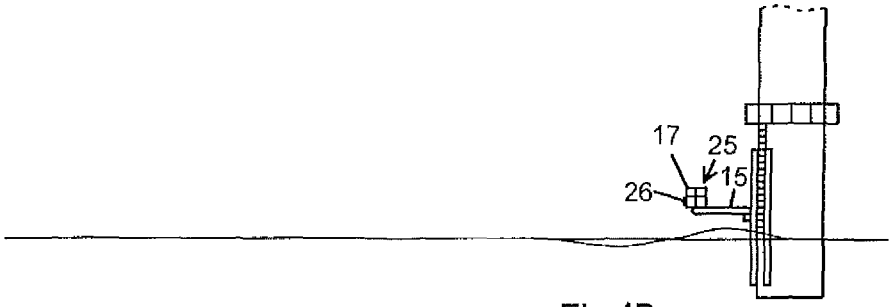
Figure 4C:
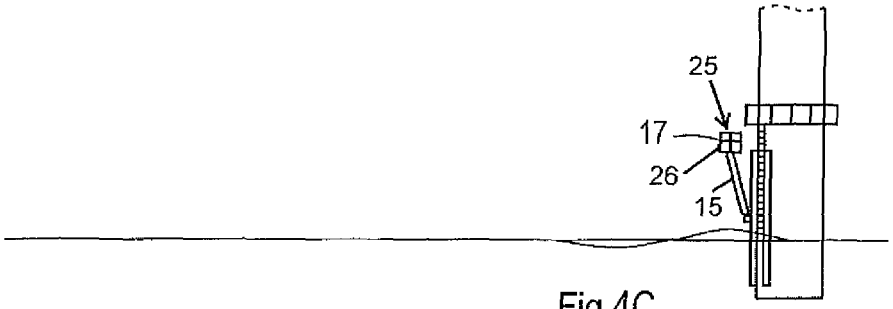
Figure 4D:
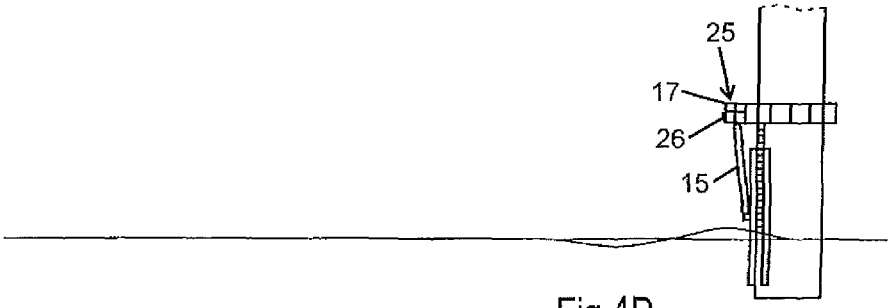
Figure 4E:
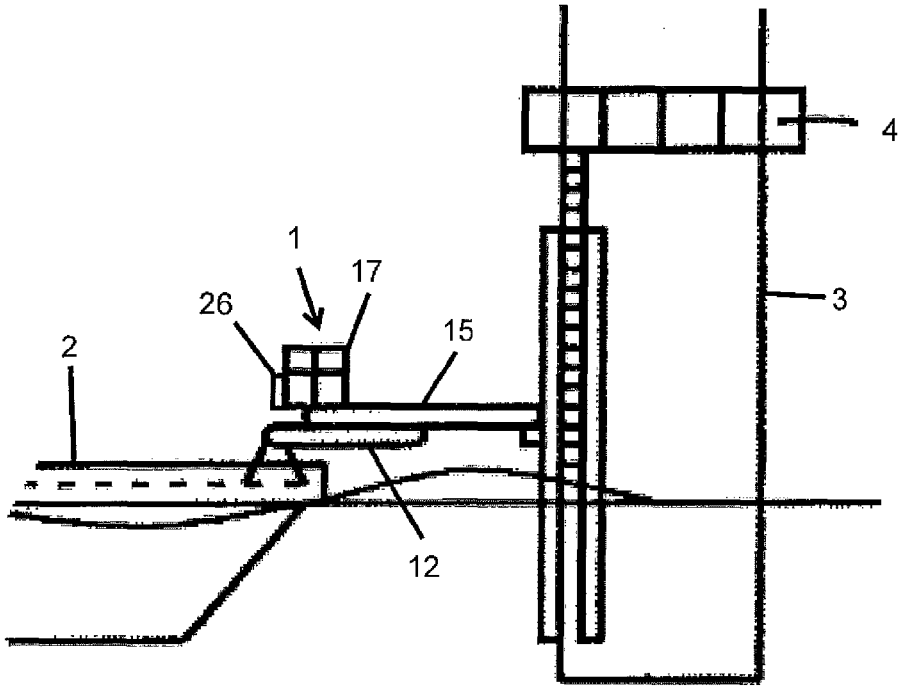

Upon coupling the first gripper 14 to an offshore structure 3, the module 25 is detached from the first arm 12 (FIG. 4A). The vessel 2 leaves once it is detached from the module 25 (FIG. 4B). The second arm 15 is extended and the basket 17 moved to the platform 4 on the wind turbine 3, enabling transfer to the platform 4 without employing the ladder 5 (FIGS. 4C and 4D).

Figure 5A:
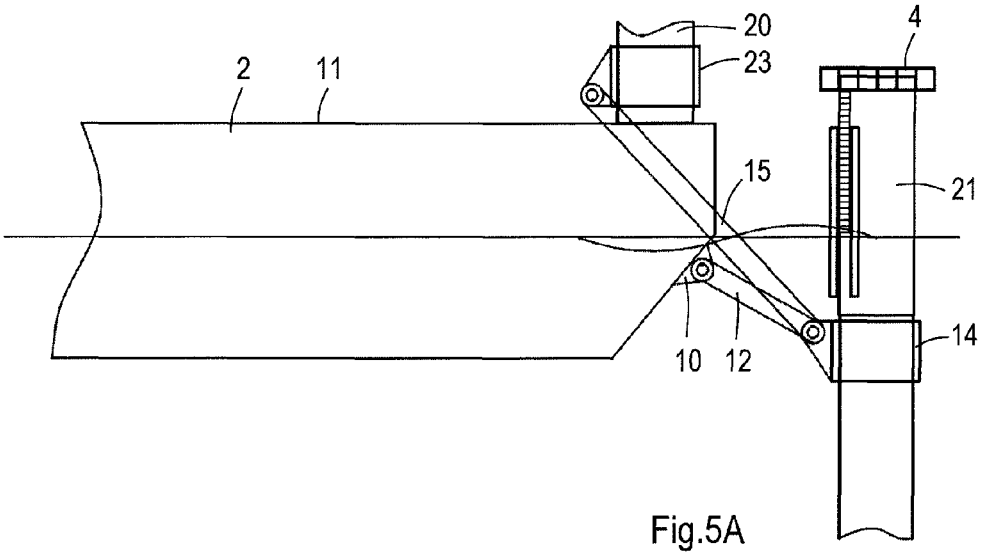
FIGS. 5A and 5B are side views of a second embodiment of the transferring device.
Figure 5B:
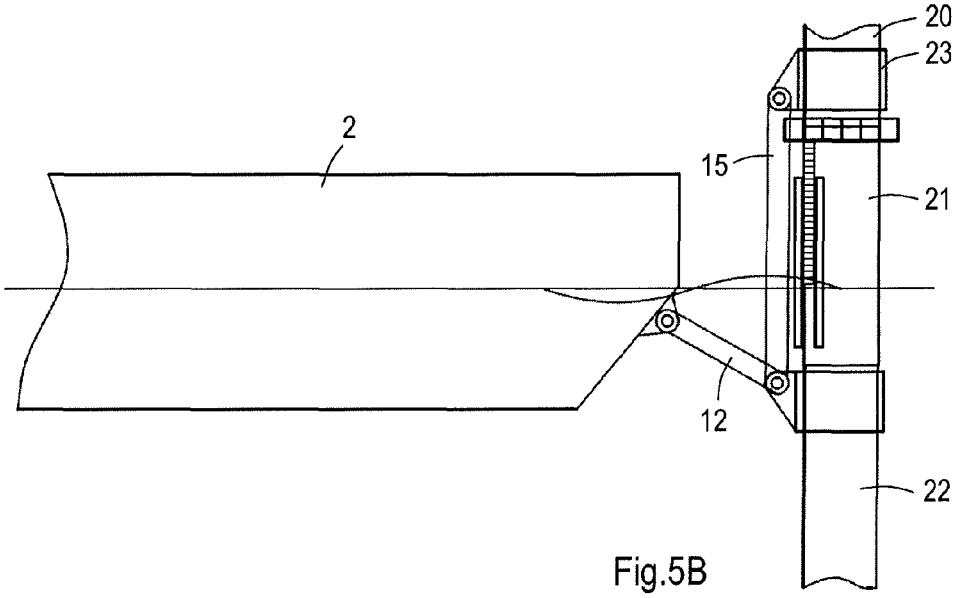

FIGS. 5A and 5B show the installation of a wind turbine tower 20 on a so-called transition piece 21 on a monopile 22. In FIG. 5A, the first arm 15 is already coupled to the monopile 22 by means of the gripper 14, in this example below the surface. Once the tower 20 on deck 11 of the vessel 2 is secured in a second gripper 23, the motion of the second gripper 23 is synchronized with the offshore structure, e.g. by moving the gripper 23 upwards, away from the deck 11 of the vessel 2. The second arm 15 is subsequently moved to the structure and the tower placed on the transition piece (FIG. 5B). In an embodiment, the tower is held in place by the second gripper 23 while it is fixed to the transition piece.

Figure 1A:
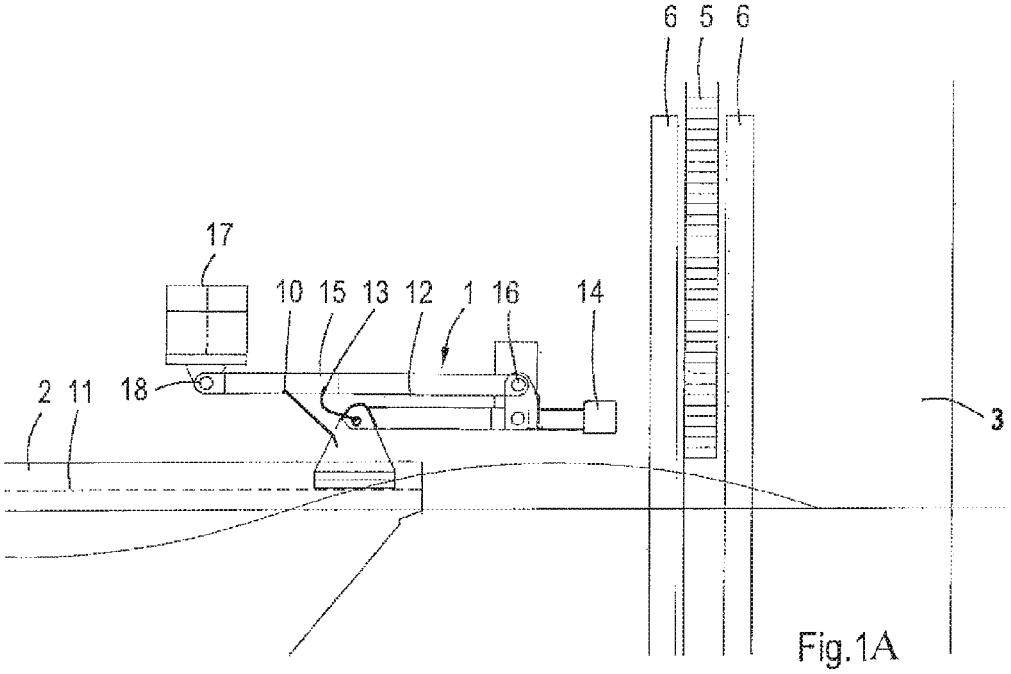
FIG. 1A is side view of the first example of the transferring device in a second position.

The invention is not restricted to the above-described embodiments, which can be varied in a number of ways within the scope of the claims. In an example, the second arm is located near the foundation during maneuvering of the first arm and, after the first arm has been coupled to the offshore structure, moved along the first arm towards the coupling (FIG. 1), thus effectively reducing the weight of the first aim while it is being maneuvered. FIG. 1A illustrates the second arm in a second position on the first arm closer to the foundation 10.

The invention claimed is:

1. A device for transferring personnel, equipment and/or structural elements from a surface vessel to an offshore structure or to another vessel, the device comprising a foundation mountable on a surface vessel, a first arm pivotally connected to the foundation with a first pivotal connection, a first gripper connected to a free end of the first arm and configured to selectively couple the first arm to an offshore structure and decouple the first arm completely from the offshore structure, and a second arm pivotally connected to the first arm with a second pivotal connection to freely move a free end of the second arm to locations higher than the first gripper.

2. The device according to claim 1 and further comprising a support configured to support personnel and/or a second gripper is connected to the free end of the second arm.

3. The device according to claim 1, wherein the second arm is pivotally connected to the free end of the first arm.

4. The device according to claim 3, wherein at least one of the pivotal connections comprises at least two gimbals.

5. The device according to claim 1, wherein the first gripper, the second arm form a module, which module is detachable from the first arm.

6. The device according to claim 5, wherein the module comprises at least one of a power supply and a manually operable power generator.

7. The device according to claim 1, wherein at least one of the arms is telescopic.

8. The device according to claim 1, wherein each of the first pivotal connection between the first arm and the foundation and the second pivotal connection between the second arm and the first arm comprises at least two gimbals.

9. The device according to claim 1, wherein at least the foundation is provided with a system configured to actively compensate for the motions of the vessel during the coupling of the first arm to the offshore structure.

10. The device according to claim 1, wherein the second arm is pivotal towards and away from a transfer position to transfer personnel, equipment and/or structural elements from the surface vessel to the offshore structure or to the another vessel, the second arm being moveable towards the offshore structure when the second arm is in the transfer position and when the first gripper is coupled to the offshore structure.

11. The device according to claim 1, wherein the second arm is movable along the first arm.

12. The device according to claim 1 wherein the second arm is connected to the first arm so as to move to and away from a position where the second arm is parallel and adjacent to the first arm.

13. A surface vessel having a deck and a device for transferring personnel, equipment and/or structural elements from the surface vessel to an offshore structure or to another vessel, the device comprising: a foundation mountable on a surface vessel, a first arm pivotally connected to the foundation, at least one gripper connected to a free end of the first arm and configured to selectively couple the first arm to an offshore structure and decouple the first arm completely from the offshore structure, a second arm pivotally connected to the first arm, and a support for carrying personnel, equipment and/or structural elements connected to a free end of the second arm, the second arm being movable to freely move the support proximate to and away from the deck to positions above the at least one gripper.

14. A method of transferring personnel, equipment and/or one or more structural elements from a surface vessel to an offshore structure, such as a wind turbine, or to another vessel comprising:

coupling a first arm, pivotally connected to the vessel, to an offshore structure, transferring personnel, equipment and/or one or more structural elements from the surface vessel to the offshore structure using a free end of a second arm that is pivotally connected to the first arm and movable to positions above a portion of the first arm coupled to the offshore structure, and completely decoupling the first arm from the offshore structure.

15. The method according to claim 14, comprising actively compensating for the motions of the vessel during the coupling of the first arm to the offshore structure.

16. The method according to claim 15, comprising switching to idle when the first arm is coupled to the offshore structure.

17. The method according to claim 14, wherein at least one of a support and a second gripper is connected to the second arm at or near its free end, wherein the motion of the support and/or the second gripper is synchronized with the vessel and, after personnel, equipment and/or structural elements have been loaded on or attached to the second arm, the motion of the support and/or the second gripper is synchronized with the offshore structure.

18. The method according to claim 14, wherein the offshore structure comprises a platform and wherein personnel and/or equipment is moved, using the second arm, from the vessel to the platform.

19. The method according to claim 14, wherein one or more structural elements are moved using the second arm , from the vessel to the offshore structure.

20. The method according to claim 14, wherein coupling the first arm comprises using a first gripper, the second arm form a module and, upon coupling the first gripper to an offshore structure, the module is detached from the first arm.

* * * * *